US006604357B2

(12) United States Patent
Bradley, Sr. et al.

(10) Patent No.: US 6,604,357 B2
(45) Date of Patent: Aug. 12, 2003

(54) ACTIVE ADAPTIVE BIAS FOR CLOSED LOOP AIR/FUEL CONTROL SYSTEM

(75) Inventors: John E. Bradley, Sr., Dearborn; Ahmed A. Omara, Ann Arbor; Douglas Ray Hamburg, Bloomfield Hills, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/952,703

(22) Filed: Sep. 14, 2001

(65) Prior Publication Data

US 2002/0029560 A1 Mar. 14, 2002

Related U.S. Application Data

(62) Division of application No. 09/532,842, filed on Mar. 21, 2000.

(51) Int. Cl.[7] ..... F02D 41/06

(52) U.S. Cl. ..... 60/276; 123/674; 701/109; 60/285

(58) Field of Search ..... 123/672, 674; 701/103, 109; 60/276, 285

(56) References Cited

U.S. PATENT DOCUMENTS

| | | | | |
|---|---|---|---|---|
| 4,733,358 A | | 3/1988 | Abthoff et al. | |
| 5,341,641 A | | 8/1994 | Nakajima et al. | |
| 5,343,700 A | | 9/1994 | Fujimoto et al. | |
| 5,359,852 A | | 11/1994 | Curran et al. | |
| 5,361,582 A | | 11/1994 | Uchida et al. | |
| 5,467,593 A | | 11/1995 | Vincent et al. | |
| 5,483,946 A | * | 1/1996 | Hamburg et al. | 123/674 |
| 5,983,874 A | * | 11/1999 | Suzuki et al. | 123/673 |
| 6,014,963 A | | 1/2000 | Narita | |
| 6,161,531 A | | 12/2000 | Hamburg et al. | |
| 6,188,953 B1 | * | 2/2001 | Yasui et al. | 701/109 |
| 6,192,310 B1 | | 2/2001 | Marcheguet et al. | |
| 6,195,988 B1 | * | 3/2001 | Yasui et al. | 60/285 |
| 6,233,922 B1 | | 5/2001 | Maloney | |

* cited by examiner

*Primary Examiner*—Erick Solis
(74) *Attorney, Agent, or Firm*—John F. Buckert; Allan A. Lippa

(57) ABSTRACT

An engine control system includes an adaptive bias sub-system (100) that generates bias values for controlling the air-fuel ratio. The sub-system (100) includes an integral controller (118) that reads an error signal from a post-catalyst switching EGO sensor (112). A plurality of noise isolation integrators (122) filter any noise resulting from a particular engine operating condition (e.g. acceleration, deceleration, idling) from the integrated error signal and stores the signal in a corresponding keep-alive memory (124) as a bias value for that engine operating condition. In a preferred embodiment, the post-catalyst feedback loop includes a gated proportional controller 116 that turns on for a limited period of time after the post-catalyst switching EGO sensor (112) switches states.

By generating active adaptive bias values based on the engine's actual performance rather than relying on static, empirically-derived bias values, the active adaptive bias sub-system (100) can continuously optimize the stored bias values as the engine and engine controller ages or if the engine control system is placed in a different vehicle.

18 Claims, 3 Drawing Sheets

ACTIVE ADAPTIVE BIAS FOR CLOSED LOOP AIR/FUEL CONTROL SYSTEM

This application is a divisional of Ser. No. 09/532,842 filed Mar. 21, 2000.

TECHNICAL FIELD

The present invention is directed to a closed-loop air-fuel control system, and more particularly to an air-fuel control system that uses a post-catalyst EGO sensor for generating air-fuel ratios.

BACKGROUND OF THE INVENTION

Known production A/F control systems use a pre-catalyst switching exhaust-gas-oxygen (EGO) sensor to maintain an air-to-fuel (A/F) ratio at a desired average value. As is known in the art, the A/F ratio is ideally at stoichiometry, or in the range of 14.3–14.7 pounds of air to 1 pound of gasoline, depending on the gasoline blend. The stoichiometric ratio is the point at which the gasoline burns completely with no excess carbon monoxide or oxygen. The ratio between the actual A/F ratio sensed by the EGO sensor and the A/F ratio at stoichiometry is called $\lambda$. Ideally, $\lambda=1.0$ during engine cruising conditions. A $\lambda$ value of less than 1.0 indicates a rich condition (i.e. there is not enough oxygen to react with the carbon and hydrogen in the fuel), and a $\lambda$ value of greater than 1.0 indicates a lean condition (i.e. there is too much oxygen and not enough fuel). The ideal $\lambda$ value can change depending on the specific engine operating condition; for example, the engine may run slightly rich during acceleration and slightly lean during deceleration. If the engine is running too rich or too lean for a particular engine operating condition, however, the catalyst efficiency will decrease, producing undesirable emissions such as HC and CO (during a rich condition) or NOx (during a lean condition).

To maintain the A/F ratio at the optimum value, known pre-catalyst switching EGO sensors use a jumpback and ramp process to maintain the A/F ratio at a desired average value. For example, if the A/F ratio is at a lean condition, the A/F ratio jumps in the rich direction and gradually moves further in the rich direction until the A/F ratio crosses stoichiometry and the pre-catalyst switching EGO sensor senses a rich condition. Once the A/F ratio crosses stoichiometry, the A/F ratio jumps back in the lean direction and gradually moves further in the lean direction until it cross stoichiometry again. This process is used to keep the A/F ratio in the switching range of the switching EGO sensor; known switching EGO sensors only sense whether the engine is running rich or lean, but not the degree to which the A/F ratio deviates from stoichiometry.

A/F ratio control can be improved by including a post-catalyst switching EGO sensor and a bias table in addition to the pre-catalyst switching EGO sensor to form a post-catalyst feedback loop. The post-catalyst switching EGO sensor and the bias table correct small errors in the A/F ratio rapidly by using the bias table to bring the A/F ratio within an estimated range and then using a proportional controller to fine-tune the A/F ratio to its optimum value after the post-catalyst EGO switching sensor has switched states. More specifically, the bias table stores biasing values that correspond to various engine operating conditions (e.g., acceleration, deceleration, idling, etc.) over the speed/load operating range of the engine. The A/F bias values in the bias table are derived empirically. During engine operation, the average A/F ratio is pre-biased as a function of engine operating conditions according to the bias table to maintain the A/F ratio within the optimum range.

Known engine controllers tend to experience two problems, however. First, the proportional feedback term in the engine controller tends to cause undesirable low frequency limit-cycle oscillations in the post-catalyst feedback loop. This oscillation problem often occurs in systems using continuous high proportional gain, which tend to overshoot the desired A/F ratio and reach the desired ratio only after several oscillations occur. Second, because the bias table is derived empirically, the values in bias the table will be optimal only for a particular vehicle. Thus, different vehicles may require different biasing tables. Further, as the vehicle ages, the optimum A/F ratios for that vehicle may change, making the empirically derived bias table values less accurate over time. As a result, a given biasing table may work adequately for multiple vehicles and/or at multiple stages of a vehicle's life, but would not be optimized for any one vehicle. The resulting A/F ratio obtained from such systems would therefore tend to lower the catalyst efficiency and produce higher emissions to some degree.

There is a need for an engine control system that can quickly and accurately reach an optimum A/F ratio, regardless of the engine's type or age, while minimizing undesirable oscillations in the post-catalyst feedback loop.

SUMMARY OF THE INVENTION

Accordingly, the present invention is directed to an engine control apparatus and method that eliminates the need for a static, empirically-derived bias table by using adaptive bias values in a keep-alive-memory (KAM) to pre-bias the A/F ratio for a given engine operating condition. The invention includes an integral controller that is coupled to the post-catalyst switching EGO sensor and that receives an error signal indicating the error between the post-catalyst switching EGO sensor signal and a post-catalyst switching EGO sensor setpoint. The setpoint is preferably a value based on an ideal sensor voltage known to be optimum for a given speed/load condition. The error signal is then sent to a selected noise-isolation integrator, based on the current engine operating condition, to remove from the signal any noise caused by the operating condition. The resulting value is then stored in the KAM as a bias value to be used for pre-biasing the A/F ratio.

In a preferred embodiment, the control system includes a gated proportional controller that operates for a limited time period after the post-catalyst switching EGO sensor has switched states, allowing an integral controller in the system to fine-tune the A/F ratio to reach the target setpoint after the proportional controller has adjusted the A/F ratio near the setpoint. This further limits the possibility of low frequency oscillations while still preserving the fast response of the proportional controller and the accuracy of the integral controller.

DETAILED DESCRIPTION OF THE PREFERRED EMBODIMENTS

Figure 1:
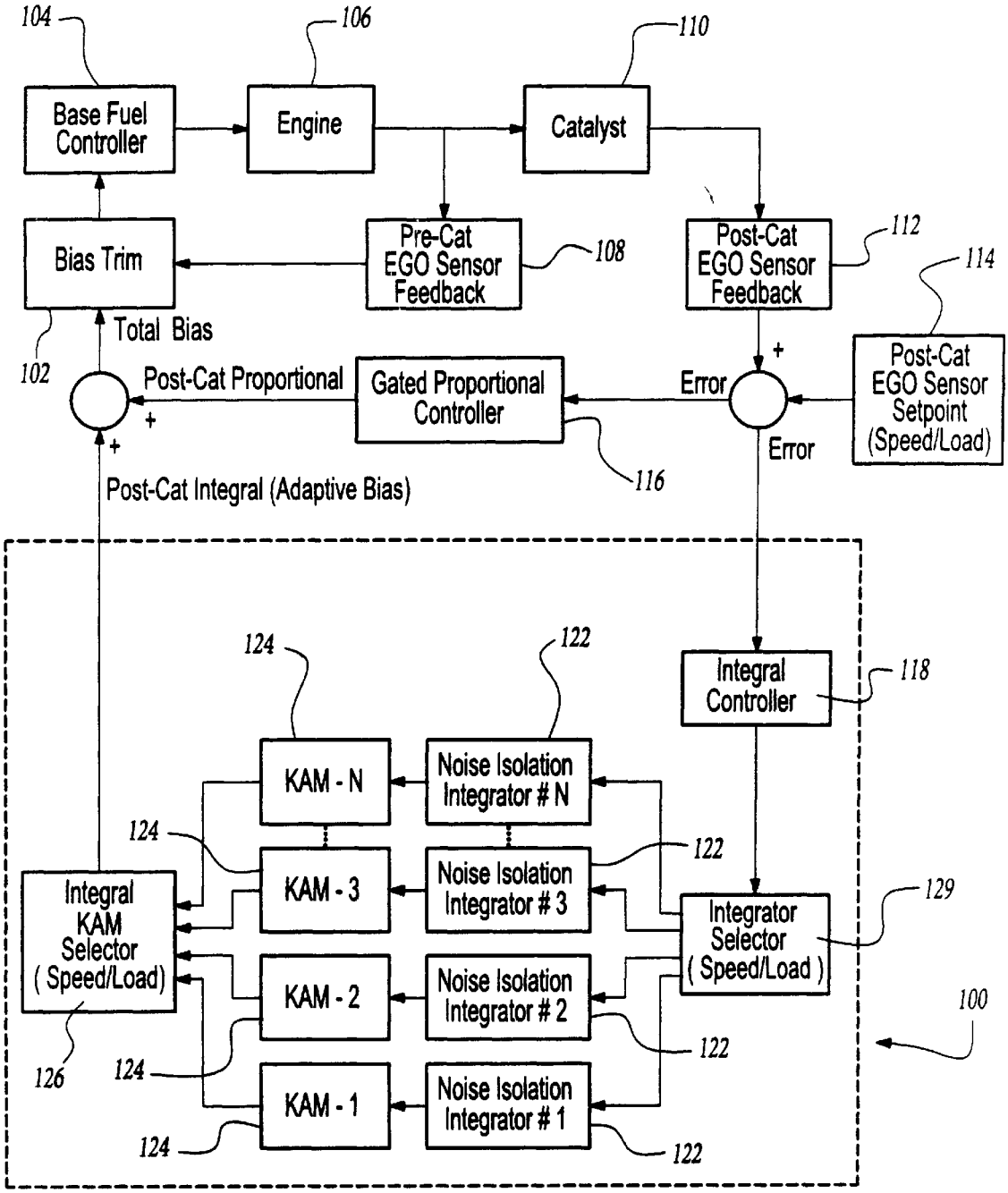
FIG. 1 is a block diagram illustrating the engine control system of the present invention.

A block diagram of an engine A/F control system containing an inventive adaptive bias sub-system 100 is shown in FIG. 1. The inventive adaptive bias sub-system 100 is outlined by dashed lines. As is known in the art, the system includes a bias trim 102 that sends a biasing signal to a base fuel controller 104, which in turn controls an engine 106 by adjusting the amount of fuel sent to it. A pre-catalyst switching EGO sensor 108 is connected to the bias trim 102 to create a feedback loop. The pre-catalyst switching EGO sensor 108 monitors the exhaust from the engine 106 and provides the data for the bias trim 102 to notify the fuel controller 104 if the A/F ratio indicates that the engine is running too rich or too lean. The pre-catalyst switching EGO sensor 108 controls the majority of the A/F biasing and quickly corrects large biasing errors.

Exhaust from the engine 106 is also sent to a catalyst 110, where undesirable emissions in the engine exhaust are reduced. A post-catalyst switching EGO sensor 112 located downstream from the catalyst 110 detects any emission breakthrough at the catalyst output. Because the post-catalyst switching EGO sensor 112 is placed downstream from catalyst 110, it is to be expected that the post-catalyst switching EGO sensor 112 will sense smaller error values than the pre-catalyst switching EGO sensor 110 due to the smaller amounts of emissions from the catalyst 110 as compared to the emissions directly from the engine 106.

The output of the post-catalyst switching EGO sensor 112 is compared with a post-catalyst EGO sensor setpoint 114, which is a function of engine speed and load and determined by the post-catalyst EGO sensor setpoint. The difference between the post-catalyst switching EGO sensor 112 signal and the post-catalyst EGO sensor setpoint constitutes the error signal and is applied to a proportional controller 116, which is connected to the bias trim 102 to form a post-catalyst proportional loop.

The error signal is also sent to an integral controller 118. The integral controller 118 provides further error correction and fine-tunes the A/F bias to ensure that the adaptive biasing data stored by the invention is correct. As is known in the art, integral controllers can eliminate the steady state error that cannot be completely corrected by a proportional controller, thereby allowing the A/F ratio to achieve the optimum value exactly rather than merely approximate it. Because integral controllers tend to be slow, however, the proportional controller 116 is used to bring the A/F ratio close to the setpoint quickly. Setting the gain of the proportional controller 116 to a higher value will cause the A/F ratio to reach the setpoint more quickly, but will also cause overshoot and undesirable low-frequency oscillations. To combine the advantages of both proportional controllers and integral controllers while preventing undesirable oscillations, the gated proportional controller 116 conducts the initial, larger scale correction of the A/F ratio relatively quickly to place the A/F ratio within an acceptable range, while the integral controller 118 fine-tunes the A/F ratio once the gated proportional controller 116 has been turned off. This allows the A/F ratio to reach the setpoint value quickly with a minimum of overshoot and oscillation.

Once the error signal passes through the integral controller 118, the integrated error signal is sent to an integrator selector 129 and then to one of several noise integration isolators 122. Each noise integration isolator 122 corresponds with an engine operating condition, such as acceleration, deceleration, idling, high-speed cruising, low-speed cruising, etc. As is known in the art, the error signal will contain noise components caused by certain operating conditions. The noise isolation integrators 122 remove the noise components from the error signal before the error signal is stored as a bias value, ensuring that the stored biasing values contain no noise.

More particularly, the integrator selector 129 selects one of the noise isolation integrators 122 depending on the engine speed and load (indicating a particular engine operating condition). The selected noise isolation integrator 122 then filters out the noise associated with the current engine operating condition and sends the resulting filtered signal to a KAM 124 for storage as an adaptive bias value corresponding to the engine operating condition. The noise isolation integrators 122 can operate in two stages to isolate the noise, as will be explained in greater detail below. Further, the system 100 can include any number of noise isolation integrators 122, depending on the number of bias values to be stored in the KAMs 124.

In one embodiment, for example, the sub-system 100 would contain three noise isolation integrators 122 where one would be used for deceleration and idle conditions, one would be used for cruise conditions, and one would be used for acceleration conditions. Because each noise isolation integrator 122 corresponds to a specific engine operating condition, adding more noise isolation integrators 122 to the system 100 allows calculation and storage of a greater number of bias values in the KAMs 124. For example, if five noise integrators were used, one could be used for deceleration conditions, one for idle conditions, one for low speed cruise conditions, one for high speed cruise conditions, and one for acceleration conditions. Adding more noise isolation integrators 122 therefore creates a more robust adaptive bias table that can provide accurate biasing for a wider range of operating conditions. In short, the integral controller 118, integrator selector 129, and the noise isolating integrator 122 work together to calculate the bias values to be stored in the KAMs 124.

An integral KAM selector 126 selects the value from one of the KAMs 124 based on the speed and load of the engine (and therefore based on the engine operating condition) and sends the bias value stored in the selected KAM 124 to the bias trim 102 for adaptive biasing of the base fuel controller 104, closing the integral feedback loop. Thus, the integrator selector 120 and the integral KAM selector 126 work together to select the correct bias value for a particular engine speed/load condition, eliminating the need for an empirically-derived bias table and providing accurate biasing regardless of the vehicle or engine/catalyst/EGO sensor aging.

Figure 2:
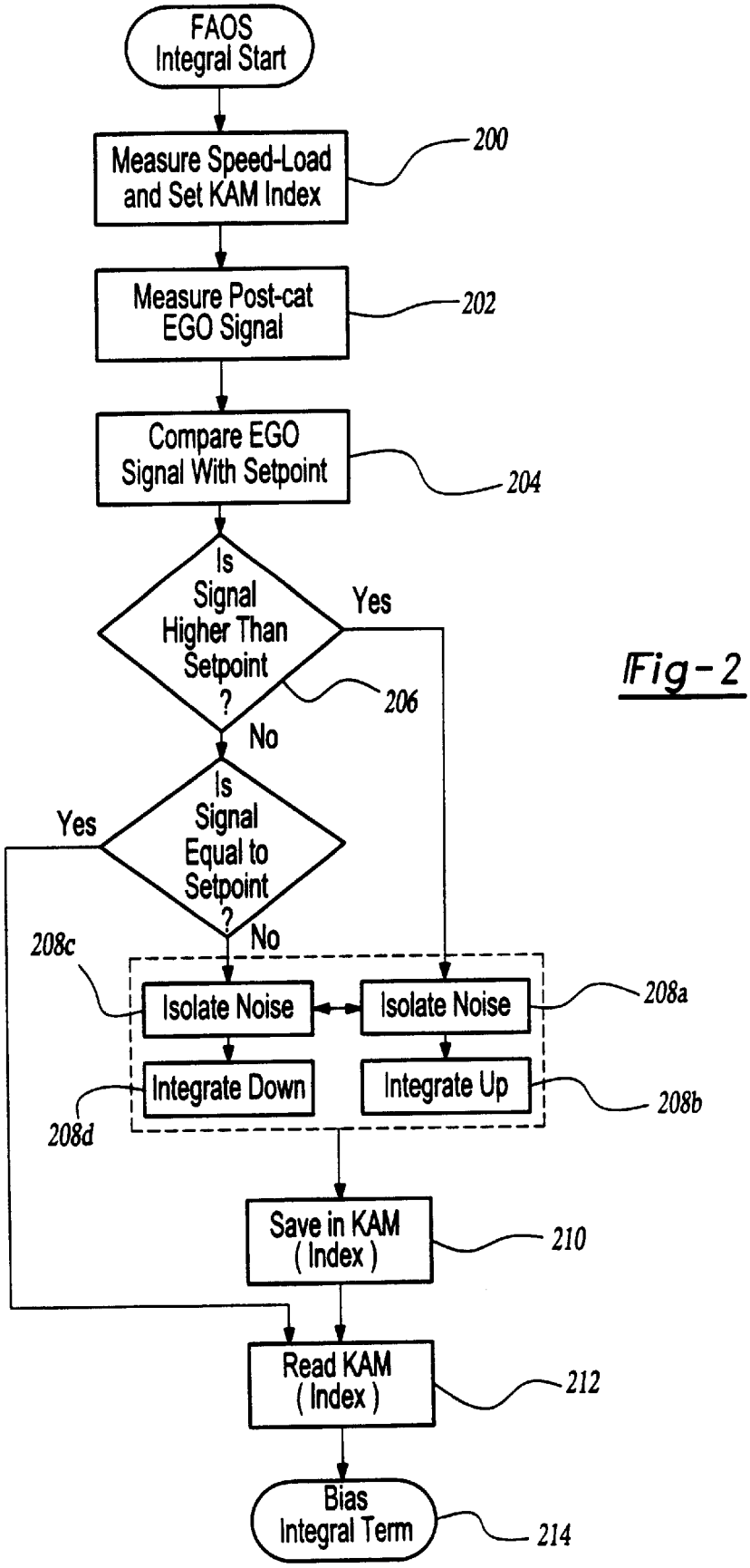
FIG. 2 is a flowchart illustrating the process in which the inventive engine control system conducts biasing.

The process for calculating the adaptive bias value is shown in FIG. 2. The process begins by measuring the engine speed/load and setting the KAM index to correspond with the engine operating condition at step 200. The post-catalyst switching EGO sensor signal is then measured at step 202 and compared with the desired setpoint corresponding to the current operating engine speed and load at step 204. If the post-catalyst switching EGO sensor signal is higher than the setpoint (indicating a rich condition) at step 206, the signal is isolated from the noise and the integral controller 118 ramps upward at steps 208*a* and 208*b* before the signal is saved in the KAM at step 210 as the adaptive bias value. Similarly, when the post-catalyst switching EGO sensor signal is lower than the setpoint (indicating a lean condition), the signal is isolated from the noise and the integral controller ramps downward at steps 208*c* and 208*d* before the signal is saved in the KAM at step 210 as the adaptive bias value. Once the bias value is saved, the adaptive bias value is read from the KAM corresponding to the current engine operating condition at step 212 and applied in accordance with the particular speed/load operating point of the engine at step 214. If the post-catalyst switching EGO sensor signal is equal to the setpoint (indicating a correctly biased condition), the integrator state does not change state and no new bias value is saved in the KAM because the adaptive bias value is already correct. In this case, the process goes directly to applying the adaptive bias value at step 214.

Figure 3:
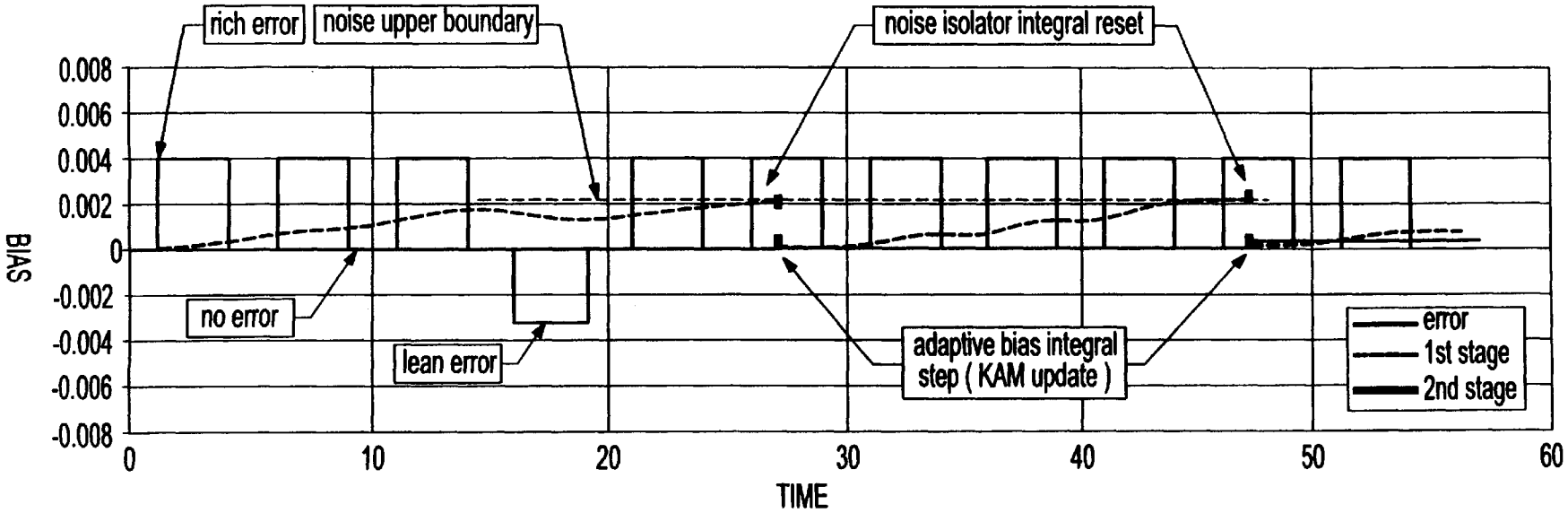
FIG. 3 is an example illustrating one way in which the invention conducts biasing and noise isolation.

An example of the operation of a two-stage noise isolation integrator 122 in the invention is presented in FIG. 3. For illustrative purposes only, the example shown in FIG. 3 has a preponderance of positive (rich condition) errors. As FIG. 3 shows, when the error is high, the first stage of the integrator 122 ramps upward. When the error is zero (i.e., in the dead band), the integrator 22 stays constant. When the error is negative (lean condition), the integrator 22 ramps downward. When the output of the noise isolation integrator 122 reaches an upper (calibratable) boundary level, it is reset to zero and the second stage of the noise isolation integrator 122 is incremented by one step. The output of the second stage of the noise isolation integrator 122 is then saved in the corresponding KAM 124 and applied to the bias trim 102, and consequently to the base fuel controller 104, according to the engine speed/load operating condition. Of course, if there is a preponderance of lean errors, the operation of the two stage noise isolation integrator is similar to that shown in FIG. 3 except the reset operation will occur when the output of the first integrator stage reaches a lower boundary level rather than an upper boundary level. Further, the noise isolation integrator 122 is not limited to the two-stage operation described above with respect to FIG. 3, but can be any component that can isolate or filter out noise resulting from various engine operating conditions from the error signal.

Because the bias values stored in the KAMs 124 are generated as the engine operates and are not fixed values, the same engine control system can be used for different vehicles and can adapt to engine/catalyst/switching EGO sensor aging with no sacrifice in performance. Further, because the adaptive bias values are calculated based on each engine's unique operating characteristics, the HC, CO, and NOx catalyst conversion efficiencies are very high, minimizing undesirable emissions and ensuring that fuel efficiency remains high even as the engine and engine controller components age. Therefore, the invention improves engine performance while eliminating the need for an empirically-derived bias table.

It should be understood that various alternatives to the embodiments Of the invention described herein may be employed in practicing the invention. It is intended that the following claims define the scope of the invention and that the method and apparatus within the scope of these claims and their equivalents be covered thereby.

What is claimed is:

1. A control system for controlling an air-fuel ratio in an engine, said engine having a catalyst and an exhaust gas sensor disposed downstream of said catalyst, said exhaust gas sensor generating a first signal, said control system comprising:

a first controller that generates a first fuel correction value based on an error signal, said error signal being a difference between said first signal and a reference setpoint;

a second controller that receives said error signal a generates a second signal based on said error signal;

a first noise isolator coupled to said second controller for generating a second fuel correction value by removing noise generated during a first engine operating condition from said second signal; and, a fuel controller that delivers a first predetermined amount of fuel to said engine based on said first fuel correction value and said second fuel correction value.

2. The control system of claim 1 further comprising a memory element coupled to said first noise isolator that stores said second fuel correction value generated by said first noise isolator.

3. The control system of claim 2 further comprising a memory selector that selects said second fuel correction value from said memory element, said memory selector being controlled by said fuel controller.

4. The control system of claim 1 wherein said first controller is a proportional controller and said second controller is an integral controller.

5. The control system of claim 4 wherein said proportional controller is a gated proportional controller that operates for a limited period of time after said downstream exhaust gas sensor switches states.

6. The control system of claim 1 wherein said first noise isolator is a two-stage noise isolation integrator.

7. The control system of claim 1 further including a second noise isolator coupled to said second controller for generating a third fuel correction value by removing noise generated during a second engine operating condition from said second signal.

8. The control system of claim 7 wherein said fuel controller delivers a second predetermined amount of fuel to said engine based on said first fuel correction value and said third fuel correction value.

9. The control system of claim 1 wherein said first operating condition comprises one of a deceleration condition, an idle condition, a low speed condition, a cruise condition, an acceleration condition, and a high speed condition.

10. A method for controlling an air-fuel ratio in an engine, said engine having a catalyst and an exhaust gas sensor disposed downstream of said catalyst, said exhaust gas sensor generating a first signal, said method comprising:

generating a first fuel correction value based on an error signal, said error signal based on said first signal and a reference setpoint;

generating a second signal based on said error signal;

filtering said second signal to remove noise generated during a first engine operating condition from said second signal to obtain a second fuel correction value; and, delivering a first predetermined amount of fuel to said engine based on said first fuel correction value and said second fuel correction value.

11. The method of claim 10 further including storing said second fuel correction value in a memory.

12. The method of claim 10 further including selecting said second fuel correction value from said memory element based on an engine operating condition.

13. The method of claim 10 wherein said first engine operating condition comprises one of a deceleration condition, an idle condition, a low speed condition, a cruise condition, an acceleration condition, and a high speed condition.

14. The method of claim 10 further including generating a third fuel correction value by removing noise generated during a second engine operating condition from said second signal.

15. The control system of claim 14 wherein said fuel controller delivers a second predetermined amount of fuel to said engine based on said first fuel correction value and said third fuel correction value.

16. An article of manufacture, comprising:

a computer storage medium having a computer program encoded therein for controlling an amount of fuel delivered to cylinders of an internal combustion engine, said engine having a first exhaust gas sensor disposed downstream of a catalyst, said exhaust gas sensor generating a first signal, said computer storage medium comprising:

code for generating a first fuel correction value based on said first signal, code for generating a second signal based on said first signal;

code for filtering said second signal to remove noise generated during a first engine operating condition from said second signal to obtain a second fuel correction value; and, code for delivering a first predetermined amount of fuel to said engine based on said first fuel correction value and said second fuel correction value.

17. The method of claim 16 wherein said computer storage medium further includes code for generating a third fuel correction value by removing noise generated during a second engine operating condition from said second signal.

18. The control system of claim 17 wherein said computer storage medium further includes code for delivering a second predetermined amount of fuel to said engine based on said first fuel correction value and said third fuel correction value.

* * * * *